US005368609A

United States Patent [19]

Inoue

[11] Patent Number: 5,368,609

[45] Date of Patent: Nov. 29, 1994

[54] SOFTENING FILLER FOR LEATHER

[75] Inventor: Shigeyuki Inoue, Akashi, Japan

[73] Assignee: Henkel Kommanditgesellschaft auf Aktien, Duesseldorf, Germany

[21] Appl. No.: 50,174

[22] PCT Filed: Oct. 21, 1991

[86] PCT No.: PCT/EP91/01995

§ 371 Date: Jun. 30, 1993

§ 102(e) Date: Jun. 30, 1993

[87] PCT Pub. No.: WO92/07962

PCT Pub. Date: May 14, 1992

[30] Foreign Application Priority Data

Oct. 30, 1990 [JP] Japan ..... 2-294597

[51] Int. Cl.[5] ..... C14C 9/00

[52] U.S. Cl. ..... 8/94.22; 8/94.2; 8/94.21; 8/94.23; 252/8.57; 427/389

[58] Field of Search ..... 252/8.57; 8/94.18, 94.21, 8/94.22, 94.23, 94.1 R, 94.2; 427/389

[56] References Cited

U.S. PATENT DOCUMENTS 3,914,360 10/1975 Gunderman et al. ..... 264/51
4,016,326 4/1977 Schaefer ..... 428/403
4,044,176 7/1977 Wolinski et al. ..... 427/256
4,837,200 6/1989 Kondo et al. ..... 503/227

FOREIGN PATENT DOCUMENTS 2236909 1/1975 France .
2445605 10/1975 Germany .
4226526 12/1967 Japan .

OTHER PUBLICATIONS

*Chemical Abstracts,* vol. 80, No. 10, Mar. 11, 1974, Columbus, Ohio; Abstract No.: 49291, Kedlaya, K. J., "Leather Lubricants", p. 71; col. 1.

*Primary Examiner*—Prince Willis, Jr.
*Assistant Examiner*—Alan D. Diamond
*Attorney, Agent, or Firm*—Ernest G. Szoke; Wayne C. Jaeschke; Daniel S. Ortiz

[57] ABSTRACT

The invention is an aqueous softening filler for leather and a process for softening leather which utilizes the softening filler. The softening filler comprises thermoexpansible microcapsules. The thermoexpansible microcapsules are impregnated into the leather from an aqueous dispersion or from a mixture containing the thermoexpansible microcapsules and fat liquor. After the leather is impregnated with the thermoexpansible microcapsules, the leather is heated to a temperature above which the thermoexpansible microcapsules expand. The process improves the softness of the leather.

13 Claims, No Drawings

SOFTENING FILLER FOR LEATHER

FIELD OF THE INVENTION

This invention relates to a softening filler for leather.

DESCRIPTION OF THE PRIOR ART

Animal hides or skins, for example of cattle, sheep, goats, pigs, deer, kangaroos, reptiles, are tanned with tanning agents, such as for example chromium, tannin, aldehyde, aluminium, zirconium, to produce tanned leather. The leather is then pared to a suitable thickness and subsequently treated with retanning agents, fillers, levelling agents or fat liquors to produce leathers with different properties for various applications. In other words, so many different properties and qualities are required that the leather cannot be processed in a single tanning process to meet the various requirements. Accordingly, the leather is treated in a second tanning process known as retanning. Various retanning agents are available according to the intended application. For example, retanning with chromium improves dyeing and softening properties while retanning with aldehyde provides soft and voluminous properties and is used for white leather as colorless tanning in the same way as aluminium or zirconium. The tanning agents also fill the leather and thus make it compact and inelastic; on the other hand, the resin-like tanning materials make the leather voluminous. Accordingly, retanning agents include fillers in the broader sense, polyurethane and polyacrylic acid resins in particular being used as fillers. These fillers have the disadvantage that they fix the leather fibers closely to one another, resulting in a reduction in flexibility. Accordingly, so-called fat liquor is often used for softening, exerting a softening effect on the leather fibers by impregnation of the leather with oil and fat. However, large quantities of fat liquor are required to make the leather sufficiently molt so that the leather becomes heavy and oily on its surface. Accordingly, softening with fat liquor is of limited practical value.

The problem addressed by the present invention was to provide a softening filler for leather which would provide the leather with considerable softness and with a light and highly voluminous feel without causing the leather fibers to adhere to one another or forming a greasy surface.

BRIEF DESCRIPTION OF THE INVENTION

The invention relates to a softening filler for leather comprising thermoexpansible microcapsules (TEMCs). The TEMCs used in accordance with the invention are microcapsules of a thermoplastic resin, in which a volatile liquid described, for example, in Japanese patent publication 42-26526 (1967) is enclosed.

Suitable TEMCs according to the invention expand at temperatures in the range from 60° to 180° C. and preferably at temperatures in the range from 80° to 150° C. and consist of a thermoplastic resin having a softening point of 70° to 100° C. and preferably 80° to 85° C. as the shell of the capsules. Suitable resins are polyvinyl chloride, polyvinylidene chloride, polyolefin, polyester, polyurethane, polyacrylate, polyvinyl acetate, polystyrene or copolymers thereof. The diameter of the microcapsules is preferably 1 to 200 μm, more preferably 3 to 100 μm and most preferably 5 to 50 μm. The increase in the expansion volume of the capsules should be of the order of 5 to 70-fold and As preferably 10 to 60-fold.

DETAILED DESCRIPTION OF THE INVENTION

It is assumed that the TEMCs used as softening filler in accordance with the invention function by a mechanism whereby the microcapsules enter the space between the leather fibers, are subsequently expanded by heat and the space thus expanded makes the leather soft and voluminous. Accordingly, the quantity of fat liquor used can be reduced so that the weight of the final leather is reduced.

The TEMCs are dispersed in a suitable medium, preferably an aqueous medium, and the leather isimmersed in this dispersion in a rotating vat. Impregnation need not only be carried out in this way, but may also be carried out, for example, by allowing the TEMC dispersion to flow onto a leather and then milling the leather under normal, high or reduced pressure to allow the TEMC to be absorbed by the leather. The quantity of TEMC absorbed should be between 1 and 8% by weight and is preferably between 3 and 5% by weight, based on the weight of the leather. This quantity may be adapted according to the required softness or thickness.

TEMC may be used on its own in the dispersion, although a dispersant, a viscosity modifier, an adhesive, a penetrating agent or a softening fat liquor may also be added where necessary. Suitable dispersants are any surfactants except for cationic surfactants, for example alkyl polyoxyethylene ether, alkylphenyl polyoxyethylene ether, sorbitan polyoxyethylene fatty acid ester, polyoxyethylene/polyoxypropylene copolymer, polyoxyethylene fatty acid ester, sorbitan fatty acid ester, fatty acid monoglyceride, polyglyceride fatty acid ester, fatty alkanolamide, polyoxyethylene acyl amide, alkylbenzene sulfonate, dioctyl sulfosuccinate, naphthalene sulfonate, alkyl naphthalene sulfonate, naphthalene sulfonate/formalin condensate, Turkey-red oil, petroleum sulfonate, alkyl sulfate, alkyl polyoxyethylene sulfate, alkyl phosphate, alkyl polyoxyethylene phosphate, alkyl betaine or other amphoteric surfactants. In a particularly preferred embodiment, the dispersant itself is used as the fat liquor.

Viscosity modifiers improve the dispersion stability of TEMCs and are used to control uniform penetration into the leather. Viscosity modifiers suitable for this purpose are methyl cellulose, hydroxyethyl cellulose, hydroxyethyl hydroxypropyl cellulose, carboxymethyl cellulose, polyvinyl acetate, polyvinyl alcohol, Na polyacrylate, etc.

The adhesive may be used to keep the TEMCs penetrated into the leather. An adhesive of the blocked isocyanate type is preferably used by virtue of its self-curing property at the thermal expansion temperature of the TEMCs. The quantity of adhesive used must be minimized to avoid any undesirable effect on softness. Adequate strength is normally obtained without the special use of an adhesive. The penetrating agent is used to allow the TEMCs or the fat liquor to penetrate readily into the leather fibers, although in many cases the fat liquor itself forms this function.

The fat liquor used may be a typical fat liquor selected, for example, from anionic surfactants, for example sulfonated oils, sulfated oils, sulfited oils, phosphated oils; nonionic surfactants, for example alkyl phenol polyoxyethylene ether, polyoxyethylene fatty acid esters, polyfunctional alcohol fatty acid esters or derivatives thereof. A typical fat liquor is sulfated oil, sulfited oil, sulfonated oil, synthetic oil, mineral oil, etc.

The fat liquor does not have to be used, but is preferably used together with the TEMC. It may be used in the same medium at the same time or, alternatively, is used before or after penetration of the TEMC into the leather and then before or after the heat treatment.

The quantity of fat liquor applied depends upon the desired softness or the quantity of TEMC used, but is generally less than 20% by weight and preferably from 4 to 12% by weight, based on the weight of the leather. More than 20% by weight does not produce any improvement in softness, but instead has an unfavorable effect by increasing weight.

A typical process for softening chrome-tanned leather according to the present invention is carried out as follows:

Chrome-tanned leather is pared to the required thickness by a paring machine. On account of its considerably lower pH value, chrome-tanned leather is difficult to soften in a typical fat liquor without pretreatment. Accordingly, the leather is pretreated with alkali and the pH value is adjusted to 6–6.5. The alkali treatment is carried out by a standard method, the leather being immersed in an aqueous solution of a mild alkali-like Na acetate or $NaHCO_3$ solution. After the alkali treatment, the leather is rinsed sufficiently with water and immersed in an aqueous dispersion of TEMC in a rotating vat. The quantity of TEMC used in the dispersion is between 3 and 5% by weight, based on the weight of the leather, and the TEMCs are dispersed in water at 30° to 40° C. with 2 to 3 times the weight of the leather which is immersed for 45 to 60 minutes. After rinsing, the leather is heated to expand the TEMCs. The heat may be applied in any form, for example as hot air, hot water, dry heat, superheated steam or by application of a hot plate. However, leather is normally heated by immersion in hot water at 70° to 90° C. or, alternatively, hot water containing 2 to 3 times the quantity by weight of the leather is introduced into the rotating vat after drainage of the dispersion and the vat is rotated for 15 to 20 minutes at 70° to 90° C. or leather freed from water is dyed, treated with fat liquor in the usual way and dried at temperatures above 80° C. to uniform expansion. As described above, the softening process with TEMCs may be carried out after the treatment with fat liquor and the thermal expansion may be carried out after immersion in the fat liquor.

The treatment with fat liquor may also be carried out in the usual way. For example, 4 to 12% by weight (based on the leather) of fat liquor and water with 1.5 to 3 times the weight of the leather are used and the leather is treated in the rotating vat for 45 to 60 minutes at 50° to 60° C.

Leather thus treated is then rinsed with water, hoarded up to drain excess tanning liquor and, thus dried, is conditioned, vibrated and stretched in the usual way. The invention may be applied not only to natural animal leathers, for example of cattle, sheep, goats, deer, reptiles, kangaroos, but also to synthetic leather.

EXAMPLES

Percentages by weight in the Examples are based on the weight of the leather unless otherwise indicated. The abbreviation min. stands for minutes while the abbreviation r.p.m. stands for revolutions per minute.

EXAMPLE 1

Chrome-tanned cowhide (ox shin: 20,000 $cm^2$, 2,500 g) was pared to a thickness of 1.0 mm and then washed with water for 30 minutes in a rotating vat. After drainage, an aqueous solution of 1.5% by weight Na acetate and 2% by weight $NaHCO_3$ dissolved in 200% water was introduced into the vat which was then left to rotate (15–18 r.p.m.) for 60 minutes at 30° C. The leather thus obtained had a pH value of 6 to 6.5.

Alkali-treated leather was completely rinsed with water. A dispersion of 5% by weight TEMC (Matsumoto Microsphare F-30; average diameter: 10 μm, Matsumoto Oil & Fat Co.) in 200% by weight water was introduced into the vat and the washed leather was treated for 45 minutes at 40° C. After drainage, an emulsion of 10% by weight fat liquor (sulfited oil, sulfated oil, natural and synthetic oil) and 150% by weight water was introduced into the vat and the leather was treated for 45 minutes at 40° C. 1% by weight formic acid was added to the vat which was then rotated for 15 minutes to adjust the pH of the leather to 3.8–4.2. The leather was then washed with water for another 15 minutes and hoarded up for 1 day to drain. The leather was then hung to dry for 2 days at 25° C., conditioned and vibrated. The stretched leather was then heated with hot dry air at 80° C., resulting in the formation of a very soft and thick leather which felt good (thickness 1.2 mm, weight 6.0 g/100 $cm^2$). The particular treatment conditions and properties of the leather are set out in Table 1.

Comparison Example 1

A leather was softened in the same way as in Example 1 except for the impregnation with TEMC. The leather obtained was softer than the original chrome-tanned leather, but felt distinctly firmer than and different from the leather obtained in accordance with Example 1 (thickness 1.0 mm, weight 5.8 g/100 $cm^2$). The particular treatment conditions and properties of the leather are set out in Table 1.

Comparison Example 2

A leather was softened in the same way as An Comparison Example 1, except that twice the weight (20% by weight) of fat liquor was used. The leather obtained was softer than the leather obtained in Comparison Example 1, but was hard and heavy and had a greasy surface. It was less voluminous and had a poor feel compared with the leather obtained in accordance with Example 1 (thickness 1.0m m, weight 7.3 g/100 $cm^2$). The particular treatment conditions and properties of the leather are set out in Table 1.

EXAMPLES 2 TO 4

Pared leather (thickness 0.8 mm, 20,000 $cm^2$, 2,500 g) was subjected to the following successive treatments in a rotating vessel: (1) retanning, (2) neutralization, washing and draining, (3) softening, (4) thermal expansion, (5) treatment with fat liquor, (6) treatment with formic acid, (7) aftertreatment (draining, rinsing, hanging to dry and finishing). The object was to obtain a soft leather. The particular conditions and properties of the leather are set out in Table 2.

Effect of the invention

Soft, light and voluminous leather with a good feel on handling can be obtained by applying the present invention.

The process according to the invention does not give rise to the disadvantage that the leather becomes heavy and greasy, as is the case with a typical fat liquor for obtaining adequate softness.

In addition the softener according to the invention does not damage the softness of the final leather, as is the case with a typical filler, such as polyurethane or polyacrylate, which fill the leather fibers and adhere firmly thereto.

TABLE 1

| | Example 1 | Comparison Example 1 | Comparison Example 2 | |
|---|---|---|---|---|
| Rinsing with water (25° C.) | 30 min. | 30 min. | 30 min. | |
| Water (30° C.) (%) | 200 | 200 | 200 | |
| Na acetate (%) | 1.5 | 1.5 | 1.5 | |
| $NaHCO_3$ (%) | 2 | 2 | 2 | |
| | 30° C./60 min. | 30° C./60 min. | 30° C./60 min. | pH 6.5 |
| Rinsing with water (25°) | 30 min. | 30 min. | 30 min. | |
| Water (40° C.) (%) | 200 | — | — | |
| TEMS*2) (%) | 5 | — | — | |
| | 40° C./45 min. | | | |
| Draining (25° C.) | 15 min. | — | — | |
| Water (40° C.) (%) | 150 | 150 | 150 | |
| Fat liquor*4) (%) | 10 | 10 | 20 | |
| | 40° C./45 min. | 40° C./45 min. | 40° C./45 min. | |
| Addition of | +1 | +1 | +1 | |
| formic acid (%) | 40° C./min. | 40° C./15 min. | 40° C./15 min. | pH 3.8 |
| Rinsing with water (25° C.) | 15 min. | 15 min. | 15 min. | |
| Hanging to dry | 2 Days | 2 Days | 2 Days | |
| Thermal expansion with air circulation (80° C.) | 10 min. | 10 min. | 10 min. | |
| Result: | | | | |
| Thickness (mm) | 1.2 | 1.0 | 1.0 | |
| Weight (g/100 $cm^2$) | 6.0 | 5.8 | 7.3 | |
| Feel | Soft and voluminous | Firm and thin | Soft and greasy | |

*2)Matsumoto Microsphare F-30 (Matsumoto Oil & Fats, average diameter 10 μm)

*4)Leather Olinor SN (Henkel Hakusui, sulfated oil) 60%
Grassan 100A (Henkel Hakusui, sulfited oil) 20%
Sirial NE (Henkel Hakusui, synthetic oil) 20%
} Mixture 100%

TABLE 2

| | Example 2 | Example 3 | Example 4 |
|---|---|---|---|
| (1) Retanning | | | |
| Water (%) | 100 | | |
| Polyaldehyde (%) | 3 | | |
| Tannin (%) | 3 | | |
| (for neutralization | 30° C./40 min. | | |
| (2) Neutralization | | | |
| Water (%) | 150 | 200 | 200 |
| $NaHCO_3$ (%) | 2 | 1.5 | 1.5 |
| Na acetate (%) | 2 | 2 | 2 |
| | 30° C./60 min. | 30° C./60 min. | 30° C./60 min. |
| pH | 6.5 | 6.5 | 6.5 |
| (3) Softening | | | |
| Acidic dye*1) (%) | 3 | 3 | 3 |
| TEMS*2) (%) | 3 | 3 | 3 |
| Sulfited oil*3) (%) | 1 | 1 | 1 |
| | 30° C./60 min. | 30° C./60 min. | 30° C./60 min. |
| (4) Thermal expansion with hot | 80° C. 30 min. | 80° C. 30 min. | 80° C. 30 min. |
| water | | | |
| (5) Treatment with fat liquor | | | |
| Water (%) | 150 | 150 | 150 |
| Fat liquor*4) (%) | 10 | 12 | 5 |
| | 60° C./60 min. | 60° C./60 min. | 60° C./60 min. |
| (6) Addition | +1 | +1 | +1 |
| of formic acid (%) | 40° C./15 min. | 40° C./15 min. | 40° C./15 min. |
| Result: | | | |
| Thickness (mm) | 1.1 | 1.1 | 1.1 |
| Weight (g/100 $cm^2$) | 6.0 | 6.1 | 5.2 |
| Feel | Very soft and voluminous | Very soft and voluminous | Very soft and voluminous |

*1)Remacor Brown HEGG e.c. (Hoechst A.G.)

*2)Matsumoto Microsphare F-30 (Matusumoto Oil & Fat, diameter 10 μm)

*3)Grassan 100A (Henkel Hausui, sulfited oil)

*4)Leather Olinor SN (Henkel Hakusui, sulfated oil) 60%
Grassan 100A 20%
Sirial NE (Henkel Hakusui, synthetic oil) 20%
} Mixture 100%

I claim:

1. A process for softening leather, which comprises: impregnating the leather with thermoexpansible microcapsules at a concentration of said thermoexpansible microcapsules between 1% and 8% by weight based on the weight of the leather; and heating the impregnated leather to a temperature at which the thermoexpansible microcapsules expand.

2. A process for softening leather of claim 1 wherein the leather is impregnated with a composition comprising thermoexpansible microcapsules and a fat liquor.

3. A process for softening leather of claim 1 wherein the leather is impregnated with thermoexpansible microcapsules and then with fat liquor and is subsequently heated to a temperature at which the thermoexpansible microcapsules expand.

4. A process for softening leather of claim 1 wherein the leather is impregnated with thermoexpansible microcapsules and then heated to a temperature at which the thermoexpansible micro-capsules expand, after which the leather is impregnated with a fat liquor.

5. A process of claim 1 which further comprises: adjusting the pH of the leather to from 6.0 to 6.5, before the leather is impregnated with the thermoexpansible microcapsules.

6. A process of claim 2 which further comprises: adjusting the pH of the leather to from 6.0 to 6.5 before the leather is impregnated with the thermoexpansible microcapsules.

7. A process of claim 2 wherein the leather is impregnated with from 3% to 5% by weight, based on the weight of the leather, of the thermoexpansible microcapsules.

8. A process of claim 3 wherein the leather is impregnated with from 3% to 5% by weight based on the weight of the leather, of the thermoexpansible microcapsules.

9. The process of claim 1 wherein the leather is impregnated with a composition comprising water, thermoexpansible microcapsules and a dispersant.

10. A product of the process of claim 1.

11. A product of the process of claim 2.

12. A product of the process of claim 3.

13. A product of the process of claim 4.

* * * * *